US010729180B2

(12) United States Patent
Kalish

(10) Patent No.: US 10,729,180 B2
(45) Date of Patent: Aug. 4, 2020

(54) ELECTRONIC VAPORIZER WITH AIR VENTS

(71) Applicant: Cole Kalish, Sherman Oaks, CA (US)

(72) Inventor: Cole Kalish, Sherman Oaks, CA (US)

( * ) Notice: Subject to any disclaimer, the term of this patent is extended or adjusted under 35 U.S.C. 154(b) by 51 days.

(21) Appl. No.: 15/730,665

(22) Filed: Oct. 11, 2017

(65) Prior Publication Data

US 2018/0279676 A1 Oct. 4, 2018

Related U.S. Application Data

(60) Provisional application No. 62/406,895, filed on Oct. 11, 2016.

(51) Int. Cl.

| | |
|---|---|
| ***A24F 13/00*** | (2006.01) |
| ***A24F 17/00*** | (2006.01) |
| ***A24F 25/00*** | (2006.01) |
| ***A24F 47/00*** | (2020.01) |
| ***H05B 3/44*** | (2006.01) |
| ***A24F 7/00*** | (2006.01) |
| ***H05B 3/06*** | (2006.01) |

(52) U.S. Cl.

CPC ..... *A24F 47/008* (2013.01); *A24F 7/00* (2013.01); *H05B 3/06* (2013.01); *H05B 3/44* (2013.01); *H05B 2203/014* (2013.01); *H05B 2203/021* (2013.01)

(58) Field of Classification Search

CPC ..... A24F 47/008; A24F 47/00
USPC ..... 131/329, 328
See application file for complete search history.

(56) References Cited

U.S. PATENT DOCUMENTS

| | | | | |
|---|---|---|---|---|
| 2014/0246020 | A1* | 9/2014 | Minskoff | A24F 47/008 128/202.21 |
| 2015/0114408 | A1* | 4/2015 | Lord | A24F 47/008 131/329 |
| 2016/0157522 | A1* | 6/2016 | Zhu | A24F 47/008 131/329 |
| 2016/0192707 | A1* | 7/2016 | Li | A24F 47/008 131/329 |
| 2016/0192709 | A1* | 7/2016 | Liu | H05B 3/40 131/329 |
| 2016/0345626 | A1* | 12/2016 | Wong | A24F 47/008 |
| 2016/0374395 | A1* | 12/2016 | Jordan | A24F 47/008 131/329 |
| 2016/0374397 | A1* | 12/2016 | Jordan | G01N 7/00 131/329 |
| 2017/0092900 | A1* | 3/2017 | Yang | H01M 2/022 |
| 2017/0181473 | A1* | 6/2017 | Batista | H05B 1/0244 |
| 2017/0354180 | A1* | 12/2017 | Fornarelli | A24F 47/008 |
| 2018/0020738 | A1* | 1/2018 | Qiu | A24F 47/008 131/329 |

(Continued)

*Primary Examiner* — Abdullah A Riyami
*Assistant Examiner* — Thang H Nguyen
(74) *Attorney, Agent, or Firm* — One LLP

(57) ABSTRACT

An electronic vaporizer including one or more air vents. The electronic vaporizer includes a triangular tubular body for housing a battery, a triangular-shaped atomizer coupled to a first end of the tubular body, the atomizer including a drip tip, a base plate, and an aperture positioned at each side of the atomizer, where each vent aperture permits air to flow into the atomizer, and a triangular-shaped base coupled to an opposing end of the tubular body. The atomizer further includes an air flow control ring for controlling the amount of air drawn into and vapor escaping the atomizer.

7 Claims, 18 Drawing Sheets

(56) References Cited

U.S. PATENT DOCUMENTS

| | | | | |
|---|---|---|---|---|
| 2018/0228219 | A1* | 8/2018 | Qiu | A24F 47/008 |
| 2018/0296777 | A1* | 10/2018 | Terry | A61M 15/0035 |
| 2018/0310627 | A1* | 11/2018 | Qiu | A24F 7/00 |
| 2019/0008211 | A1* | 1/2019 | Fornarelli | A24F 47/008 |
| 2019/0037928 | A1* | 2/2019 | Fornarelli | H05B 3/42 |
| 2019/0053539 | A1* | 2/2019 | Davis | A24F 47/008 |

* cited by examiner

ELECTRONIC VAPORIZER WITH AIR VENTS

RELATED APPLICATIONS

This application claims priority of U.S. application Ser. No. 62/406,895, filed on Oct. 11, 2016, titled ELECTRONIC VAPORIZER WITH AIR VENTS, which application is incorporated in its entirety by reference in this application.

TECHNICAL FIELD

The invention generally relates to an electronic vaporizer, and more particularly, to an electronic vaporizer including multiple air vents.

BACKGROUND

Electronic vaporizers, also known as vapors, vapes, or e-cigarettes, have become more popular as an alternative to tobacco cigarettes. Current commercially available electronic vaporizers generally include a round tubular body holding a battery for powering an atomizer. The atomizer heats a liquid, also known as "juice" or "e-liquid", and creates vapor or smoke which is inhaled by the user. Some electronic vaporizers include temperature control to prolong the life of the wick and coil in the atomizer. The users may select different types of liquid that, when heated, produce different amounts of vapor. However, the electronic vaporizers do not control the amount of vapor that is produced and some amount of vapor escapes without being inhaled and enjoyed by the users.

It is therefore desirable to provide an electronic vaporizer that includes multiple air vents and mechanism for controlling the amount of vapor inhalable by the user, and that provides advantages heretofore unknown in the art.

SUMMARY OF THE INVENTION

An electronic vaporizer including one or more air vents is provided. The electronic vaporizer includes a triangular tubular body for housing a cylindrical battery, a triangular-shaped atomizer coupled to a first end of the tubular body, the atomizer including a drip tip, a base plate, and an aperture positioned at each side of the atomizer, where each vent aperture permits air to flow into the atomizer, and a triangular-shaped base coupled to an opposing end of the tubular body. The atomizer further includes an air flow control ring for controlling the amount of air drawn into and vapor escaping the atomizer.

In further implementations, the electronic vaporizer includes a triangular tubular body for housing three battery sources, a triangular-shaped atomizer positioned on top of the triangular tubular body, the atomizer including a drip tip, a base plate, and an aperture positioned at each side of the atomizer, each vent aperture permitting air to flow into the atomizer, and a triangular-shaped base. The atomizer further including an air flow control ring for controlling the amount of air being drawn into the atomizer.

In some implementations, the circuit configuration of the electronic vaporizer may switched between a parallel circuit to a series circuit by the changing the battery orientation. In parallel, the electronic vaporizer produces less power, resulting in longer battery life. In series, the electronic vaporizer produces more power (i.e., voltage), resulting in more cloud production and an enhanced "vape" experience.

In further implementations, the electronic vaporizer includes a triangular tubular body for housing an battery source, a triangular-shaped atomizer coupled to a first end of the tubular body, the atomizer including a drip tip, a base plate, and an aperture positioned at each side of the atomizer, each vent aperture permitting air to flow into the atomizer, and a triangular-shaped base coupled to an opposing end of the tubular body. The base plate and base each include vents permitting air to communicate between the atomizer and the tubular body such that when a user inhales vapor through the drip tip, atmospheric air is drawn into the vaporizer through the base to promote convection cooling of the at least one battery source.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present invention may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

FIGS. 1-7 illustrate examples of various implementations of an electronic vaporizer that includes one or more air vents. Generally, the electronic vaporizer includes a triangular tubular body for housing one or more cylindrical batteries, a triangular-shaped atomizer positioned on top of the triangular tubular body, the atomizer includes a drip tip, a triangular-shaped body having three vent apertures positioned along three sides of the body, and a triangular-shaped base. The atomizer further includes an adjustable (i.e., slidable) air flow control ring for controlling the amount of vapor escaping the atomizer.

Figure 1:
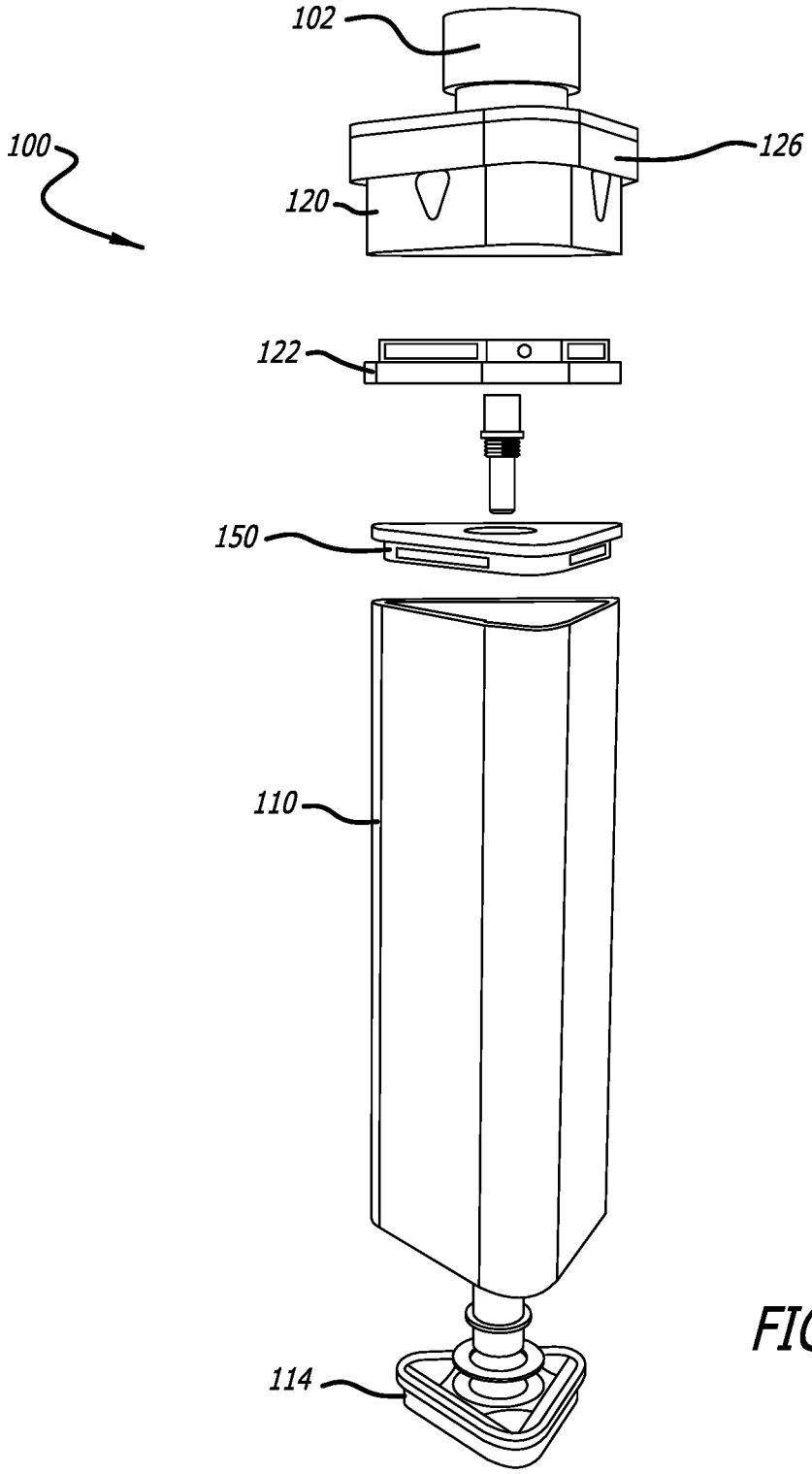
FIG. 1 is a side perspective view illustrating one example of an electronic vaporizer in accordance with the teachings of the present invention.

FIG. 1 is a perspective side view of one example of an electronic vaporizer 100 of the present invention. The electronic vaporizer 100 generally includes a drip tip 102, a casing having a body 110, and an atomizer 120. The casing body 110 and the atomizer 120 may be constructed of titanium, stainless steel, aluminum, ceramic, or any other suitable material.

In the implementation shown, the drip tip 102 may be detachably coupled to the top of the atomizer 120. For example, the drip tip 102 may be threadedly coupled or snapped into an orifice formed in the center of the top of the atomizer 120. The drip tip 102 serves as a mouthpiece for "dripping." For purposes of the present invention, "dripping" refers to a method of vaping where the user drips "juice" or vapor fluid directly onto the atomizer's heating coils. As further discussed below, once the vapor fluid is heated, it vaporizes and is inhaled by the user.

While this disclosure describes an atomizer used for dripping, the present invention may apply to other methods of vaping. The drip tip 102 may be made of Delrin®, ceramic, aluminum, stainless, or any other material that will quickly absorb any stray heat to cool the tip for the user's mouth.

Figure 2A:
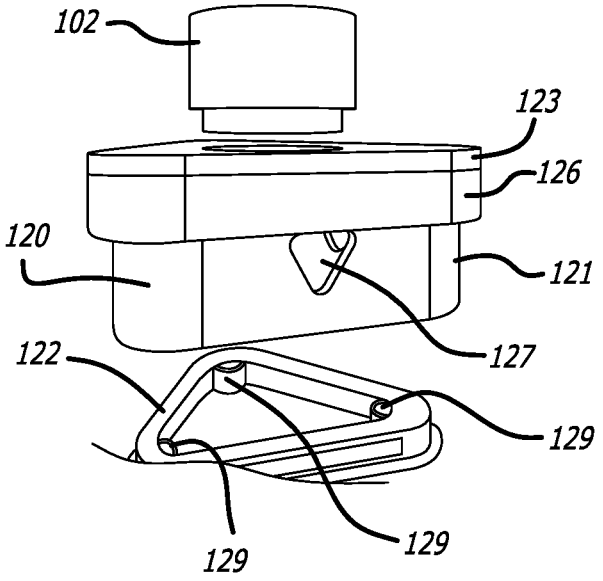
FIG. 2A is a perspective view of one example of an atomizer of an electronic vaporizer in accordance with the teachings of the present invention.
Figure 2B:
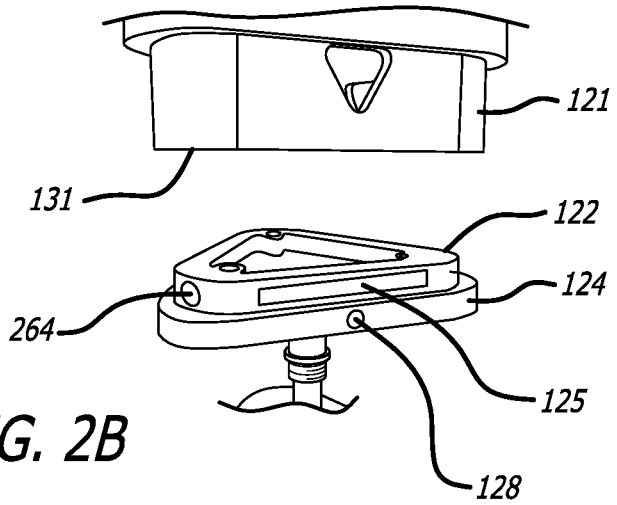
FIG. 2B is another perspective view of the atomizer of FIG. 2A.
Figure 2C:
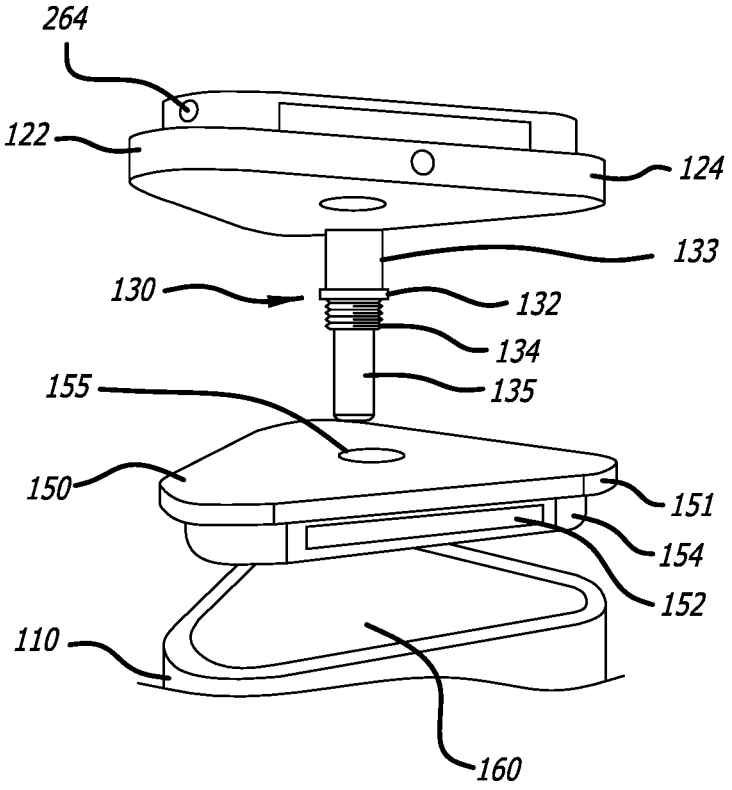
FIG. 2C is a perspective view of the atomizer of FIG. 2A illustrating how the base of the atomizer is coupled to the top body cap of the casing body.

The casing body 110 may comprise an elongated tube having a hollowed interior 160 (FIG. 2C). It is preferred that the casing body 110 have a shape corresponding to the shape of the atomizer 120. In the example implementation shown, the casing body 110 has the shape of an equilateral triangle. As will be described in more detail herein, the casing body 110 may store one or more batteries. The casing body 110 may include a casing top body cap 150 coupled to one end of the body 110 and a casing base 114 coupled to an opposite end of the body.

The top body cap 150 and casing base 114 may be constructed of titanium, stainless steel, aluminum, ceramic, or any other suitable materials. The top body cap 150 and casing base 114 enclose the hollowed interior 160 to form a battery chamber for housing one or more batteries.

It should be noted that the electronic vaporizer 100 may be used with a battery with cylindrical shape, for example, rechargeable lithium ion 18650 and 26650 batteries. As mentioned above, the battery is housed within the body 110. Because the body 110 has a triangular shape and the battery has a circular shape, when the battery is housed in the body 110, the three triangular corners of the body 110 remain open and may advantageously provide a venting mechanism, for example, for convection cooling, as will be further discussed below.

FIGS. 2A-2G illustrate the atomizer 120 in more detail. As shown, the atomizer 120 preferably has a triangular shape. The atomizer 120 includes a body 121 having an enclosed top and an opposing open end. The atomizer 120 further includes a top flange 123 extending along the top of the body 121.

Each side of the body 121 may include an aperture 127. As will be described in more detail herein, the apertures 127 may allow vapor to escape or exit the atomizer 120. The air flow control ring 126 may be slid along the outside of the body 121. As the air flow control ring 126 is adjusted up or down the body 121, it may control the amount of opening of the apertures 127. As a result, the user may control the amount of air being drawn into the atomizer 120. In particular, when a user inhales (i.e., sucks in) vapor through the drip tip 102, air is drawn into the atomizer 120 interior through the apertures 127 (see FIG. 2F). The drawn-in air is then re-circulated within the atomizer 120 interior and mixes with the vapor generated by the heating coils of the atomizer. The more air that is permitted to enter the atomizer 127 interior, the stronger the potency of the vapor. A secondary function of the apertures 127 is to facilitate convection cooling of the atomizer's heating coils.

The width (or height) of the air flow control ring 126 may be sized to completely cover the aperture 127. The air flow control ring 126 may be constructed of titanium, stainless steel, aluminum, ceramic, or any other suitable material. As discussed above, the air flow control ring 126 translates between a first, upward position, where the apertures 127 are not obstructed, and a second, downward position, where the apertures 127 are completely covered by the air flow control ring 126, to a regulate the amount of air drawn into the atomizer. The top flange 123 provides a stop so that the air flow control ring 126 may not slide out of the atomizer 120 when it is moved upward.

In the example shown, the apertures 127 have a triangular shape. However, in other implementations the apertures 127 may comprise other geometric shapes.

The atomizer 120 may further include a atomizer base 122. The atomizer base 122 and the body 121 form and atomizer chamber 131 (FIG. 2B) for housing the heating coils and other atomizer components within the interior of the atomizer.

In the example implementation shown, the base 122 has the shape of an equilateral triangle. The base 122 may include a flange 124 extending along the bottom of the base 122. The base 122 may be sized to fit into the bottom (i.e., open end) of the atomizer body 121, as shown in FIG. 2F. The flange 124 provides a stop when the base 122 is fit into the bottom of the body 121. The flange 124 may also provide a stop so that the air flow control ring 126 may not slide out of the atomizer 120 when it is moved downward.

As better shown in FIG. 2B, the base 122 may include a friction protrusion or grip 125 on each side of the base 122 to provide a friction fit between the base 122 and the inside wall of the body 121. The friction grip 125 may be made of, for example, Delrin®, plastic, rubber, or any other suitable material. Each side of the flange 124 may include an aperture 128. The aperture 128 may be threaded for receiving a fastener, such as an Alley-key screw, that secures the heated coils onto the board of the atomizer, as further described herein.

In some implementations, the atomizer 120 may include three negative posts 129 positioned at the three inside corners (or angles) of the base 122, as shown in FIG. 2A. The negative posts 129 may comprise a slot or a slit. In some implementations, each negative post 129 may be coupled to one coil (not shown), forming a 3-coil atomizer. In some implementations, each negative post 129 may be coupled to two coils, forming a 6-coil atomizer. In yet some implementations, each negative post 129 may be coupled to three coils, forming a 9-coil atomizer.

Referring now to FIG. 2C, the atomizer 120 may include a positive pin 130 coupled to the center of the base 122. The pin 130 may include an upper section 133, a flange 132 positioned in a center portion of the pin 130, a threaded section 134, and a lower section 135. The upper section 133 is configured to fit within an aperture 138 formed in the center of the base 122, as shown in FIG. 2E, with the flange 132 abutting the inner, bottom surface of the base 122. The threaded section 134 may be used to attach (i.e., fasten) the atomizer 120 a top body cap 150 (which will be described in more detail herein) via a corresponding threaded aperture 155. When the atomizer 120 is attached to the top body cap 150, the lower section 135 of the positive pin 130 extends downwardly from the top body cap 150 into the inner space of the body 110. As will be described in more detail herein, the lower section 135 may thus provide connection to a positive terminal of a battery stored inside the body 110.

According to this configuration, the base 122 serves as a negative terminal or ground and the positive pin 130 serves as the positive terminal of the atomizer circuit. The upper section 133 of the positive pin 130 may include an insulator, such as a rubber or Delrin® ring, to prevent the positive pin 130 from touching the base 122 as it extends through the aperture 138 (FIG. 2E) in the center of the base 122.

Figure 2D:
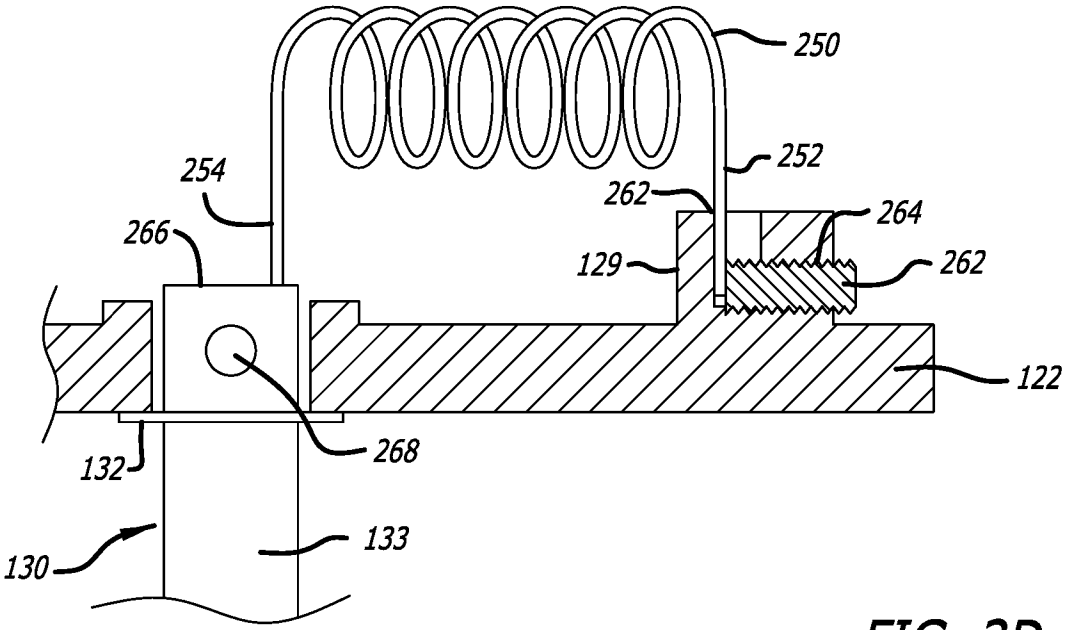
FIG. 2D is a partial cross-section view of the atomizer of FIG. 2A taken along line 1-1.
Figure 2E:
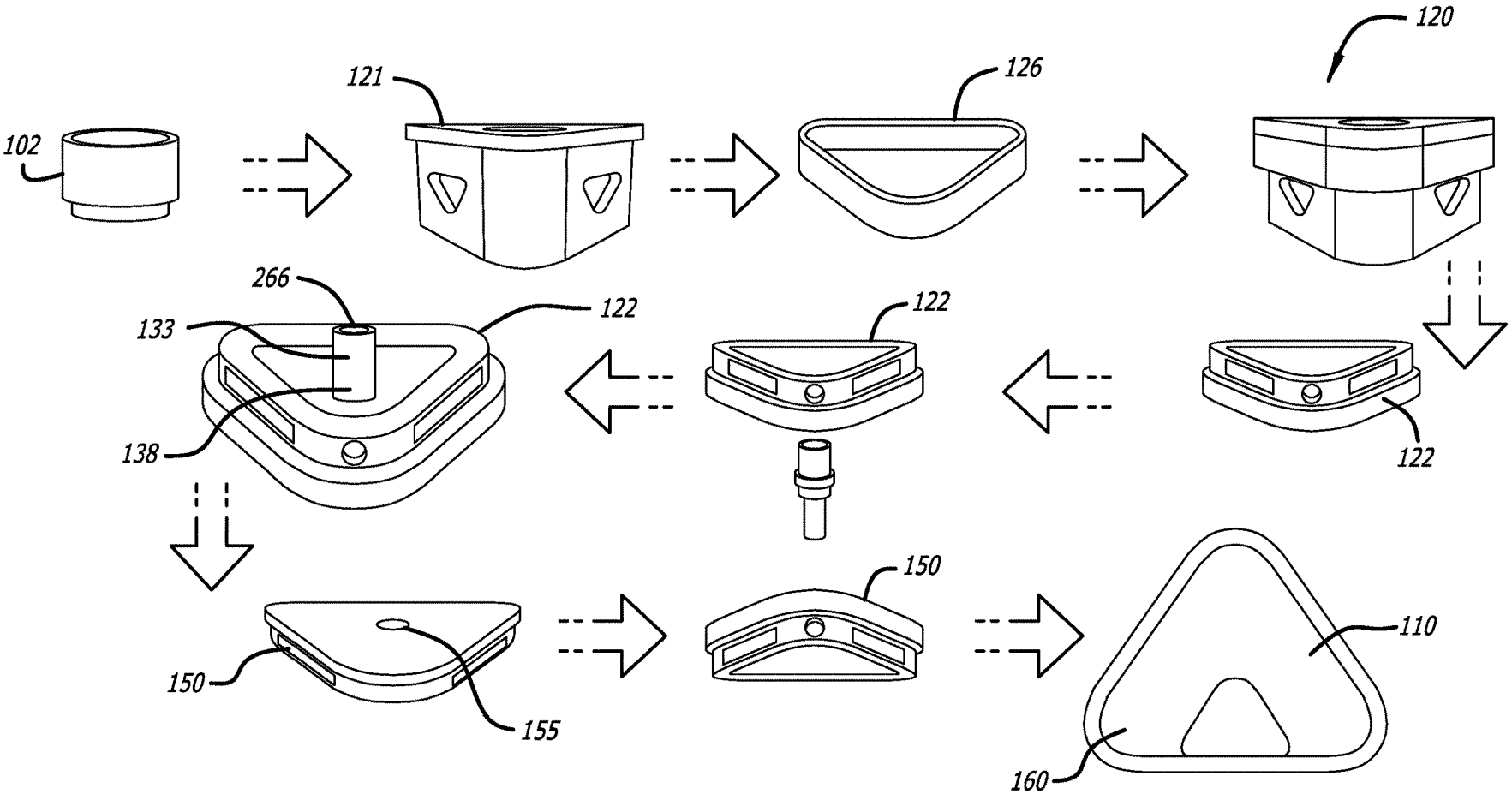
FIG. 2E illustrates an assembly view of the of the atomizer of FIG. 2A.
Figure 2F:
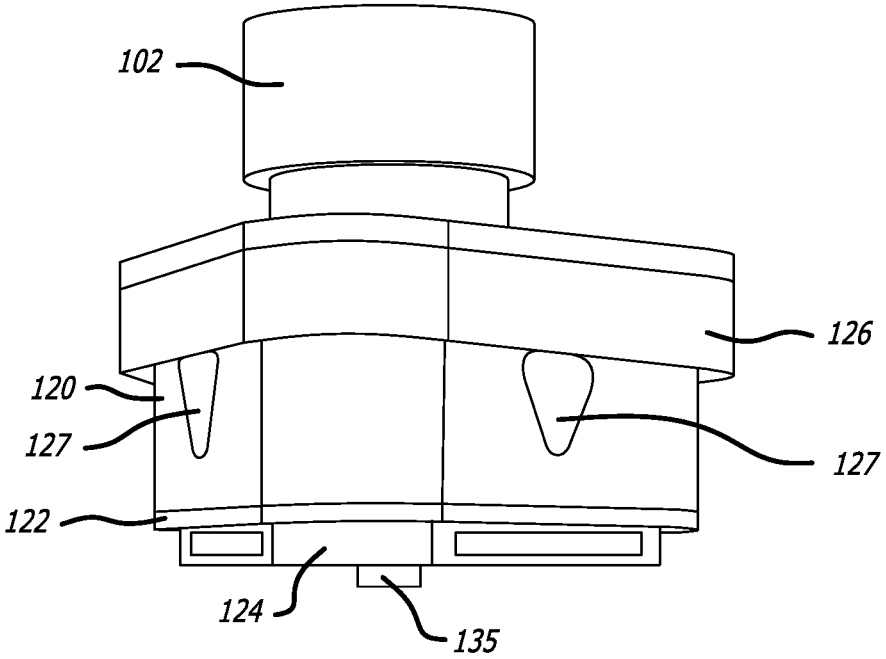
FIG. 2F illustrates another perspective view of the atomizer of FIG. 2A.

As shown in FIG. 2D, at least one coil 250 may be coupled to each negative post 129 (FIG. 2A) and the upper section 133 of the positive pin 130, forming a complete circuit in the atomizer 120. As described herein, in some implementations, two coils or three coils may be coupled between each negative post 129 and the positive pin 130.

In this example, the coil 250 may be coupled the negative post 129 by feeding a lead 252 through a slot 260 in the negative post 129. Lead 252 may be secured to the negative post 129 by a fastener 262, for example an Allen screw, that threads through a threaded fastener hole 264 formed in the corner of the base 122. The location of the fastener hole 264 corresponds with the location of the negative post 129, such that when the fastener 262 engages the fastener hole 264, the fastener 262 presses the lead 252 against the inner walls of the slot 260.

In a similar way, the coil 250 may be coupled the positive pin 130 by feeding an opposite lead 254 through a hollowed-out portion 266 of the upper section 133 of the positive pin 130. The upper section 133 may also include a positioning orifice 268 for receiving the fastener (not shown) extending through aperture 128 (FIG. 2B). Similar to fastener 262, when the fastener extending through aperture 128 engages the aperture 128, the fastener is configured to pass through the positioning orifice 268, such that the fastener presses lead 254 against the inner wall of the hollowed out portion 266. In addition to securing lead 254 to the upper section 133 of the positive pin 130, the fastener extending through aperture 128 further serves to secure the positive pin 130 to center of the base 122.

FIG. 2C illustrates the top body cap 150. In the example implementation shown, the top body cap 150 has the shape of an equilateral triangle. The top body cap 150 may be used to cover the top opening of the body 110 by fitting the top body cap 150 into the hollow interior 160, and provide negative conducting contact between the body 110 and the atomizer 120. The top body cap 150 may include a flange 151 and a friction protrusion or grip 152 on each side thereof to provide a tighter fit between the top body cap 150 and the inside wall of the body 110. The flange 151 seals the top body cap 150 to the top of the body 110. The friction grip 152 may be made of, for example, Delrin®, plastic, rubber, or any other suitable material. As described herein, the top body cap 150 includes a threaded aperture 155 position in the center of the top body cap 150 and sized to receive the corresponding threaded section 134 of the positive pin 130.

FIG. 2E illustrates a partial exploded view of the atomizer 120 and how the various parts of the atomizer 120 may be assembled and coupled together with the top body cap 150 and the body 110. As shown, the drip tip 102 may be coupled to the top of the atomizer body 121. The air flow control ring 126 may be assembled about the body 121 prior to the base 122 being secured to the bottom of the body 121. Prior to securing the base 122 to the bottom of the body 121, the positive pin 130 may be installed in the center of the base 122. Once the atomizer 120 is assembled, the atomizer may be coupled to the top body cap 150 of the casing body 110 by threading the threaded section 134 of the positive pin 130 into the threaded aperture 155 located in the center of the top body cap 150.

FIG. 2F illustrates a side view of the atomizer 120. In some example implementations, the drip tip 102 resembles a hollow cylindrical tube. The drip tip 102 may be coupled, for example, screwed in or pushed in, on to an aperture positioned at the top of the atomizer 120. In an example operation, a vapor liquid, or "juice", may be dripped through the open space of the drip tip 102, on to an absorbent substrate, for example, an organic cotton material, positioned inside the atomizer 120. The absorbent material acts as a wick for absorbing the "e-liquid." The "e-liquid" or "e-juice" may comprise various flavors.

Figure 2G:
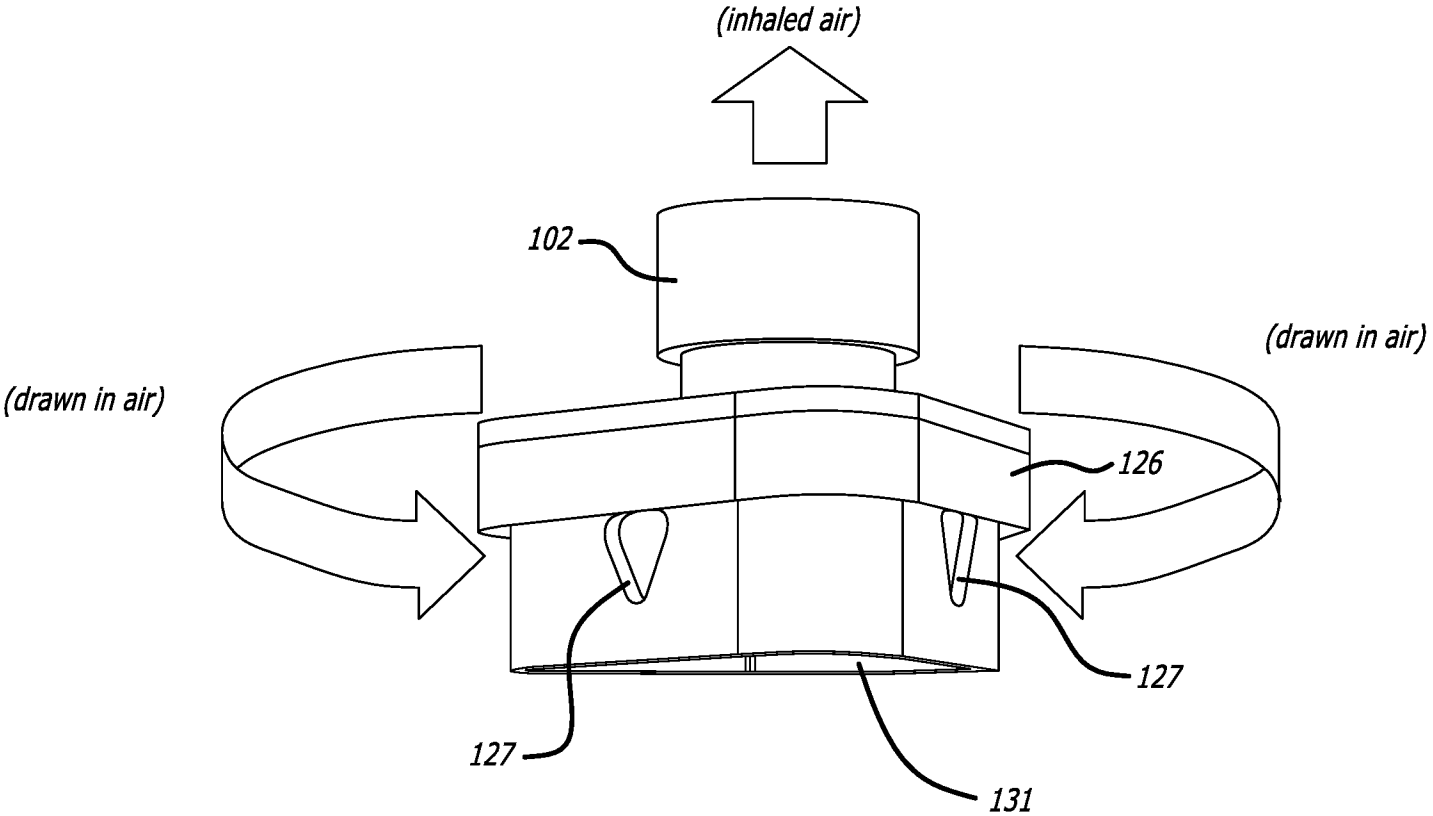
FIG. 2G illustrates a perspective view of the atomizer of FIG. 2A illustrating how air is drawn into the atomizer chamber.

One or more heating coil may be wrapped around the absorbent substrate. As the coil heats up during use, it causes the liquid to vaporize. The user may place his or her mouth over the open end of the drip tip 102, draw a breath and inhale the vapor or smoke. As described herein, the user may adjust the air flow control ring 126 along the outside surface of the atomizer 120 to control the amount of opening of the apertures 127. When the apertures 127 are fully covered by the air flow controller 126, vapor is inhaled by the user with less potency. When the apertures 127 are not fully covered by the air flow controller 126, air may be drawn in through the apertures 127 and mixed with the vapor, thus permitting the user to inhale more vapor with a stronger "hit" or potency, as shown in FIG. 2G.

In other implementations, the atomizer 120 may be configured to vaporize plant-based substances. In such implementations, the plant-based substance may be placed in a receptacle that is electrically coupled to the heating coils. The receptacle may be made of ceramic or any other suitable material. The heating coils heat the receptacle which, in turn, vaporizes the plant-based substance.

Figure 2H:
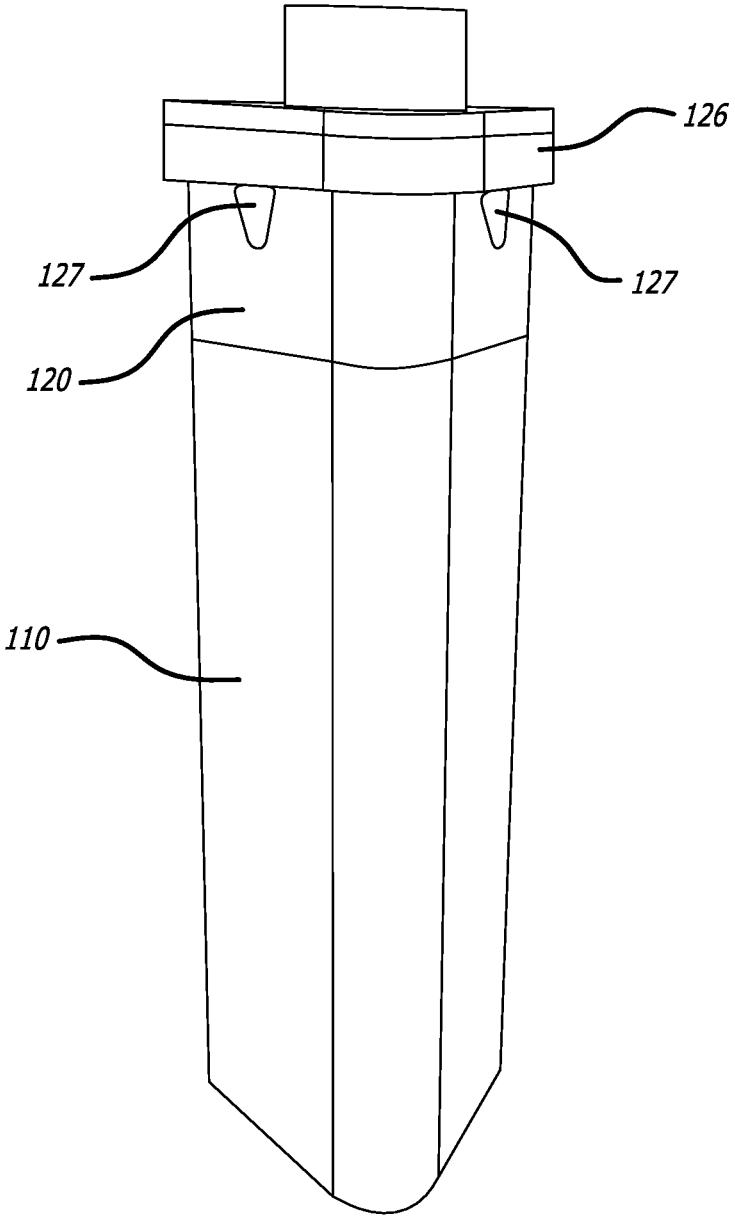
FIG. 2H is a perspective view of the atomizer assembled atop the casing body.

FIG. 2H illustrates a side view of the atomizer 120 assembled atop the body 110. As shown, the shape of the atomizer 120 corresponds with the shape of the casing body 110.

FIGS. 3A-3D illustrate a body bottom cap (or base) 200. The bottom cap 200 may provide a bottom cover for the body 110, and a conducting connector to the negative terminal of the battery housed inside the body 110. It is noted that the body 110 may also provide negative conducting. The bottom cap 200 may include a body 210 having a flange 211 positioned at the top edge thereof. The bottom cap 200 may include a negative seat 218 which may be coupled to the negative terminal of the battery housed inside the body 110. A tubular attachment device 216 made of Delrin®, for example, may be positioned below the negative seat 218 to encapsulate a bottom portion of the negative seat 218. A magnetic ring 214 may be positioned below and sized to fit around the attachment device 216. The magnetic ring 214 is also sized to fit into a circular aperture 213 positioned in the center of the bottom cap 200. The bottom cap 200 advantageously includes three venting apertures 212 positioned at the three corners of the bottom cap 200. The venting apertures 212 may provide cooling for the body 110. Although the venting apertures 212 are shown in the example as having triangular shape, they may have other geometric shapes.

When assembled, the flange 211 is coupled to a bottom lip 222 of the body 110 to enclose the hollow interior 160 of the body 110. The flange 211 may be coupled to the bottom lip 222 by fasteners, press-fit, snap fit, latches, release mechanisms, or any other suitable means.

The bottom cap 200 may further include a push button 220 for activating (turning ON) or deactivating (turning OFF) the electronic vaporizer 100. The push button 220 may cause the seat 218 to contact with the a negative terminal of the battery for activating the electronic vaporizer 100.

Figure 3C:
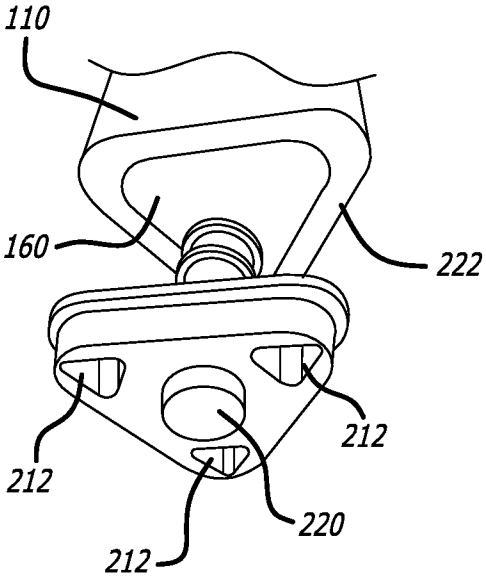
FIG. 3C is a bottom perspective view of the bottom cap of FIG. 3A.
Figure 3B:
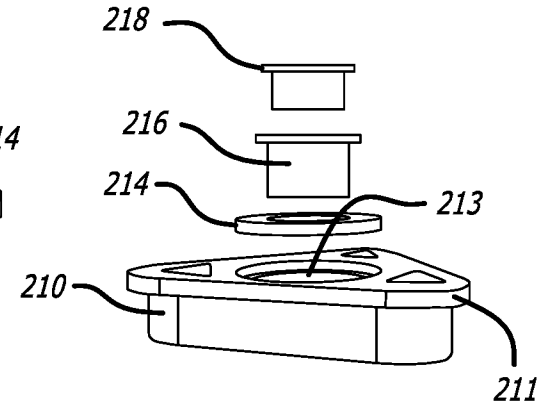
FIG. 3B is a perspective view of the bottom cap of FIG. 3A illustrating how the components of the bottom cap are assembled together.
Figure 3A:
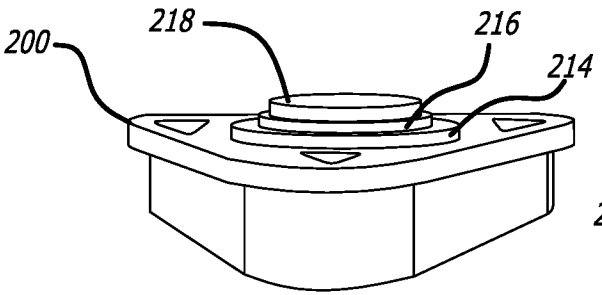
FIG. 3A is a perspective view illustrating one example of a bottom cap of an electronic vaporizer in accordance with the teachings of the present invention.
Figure 3D:
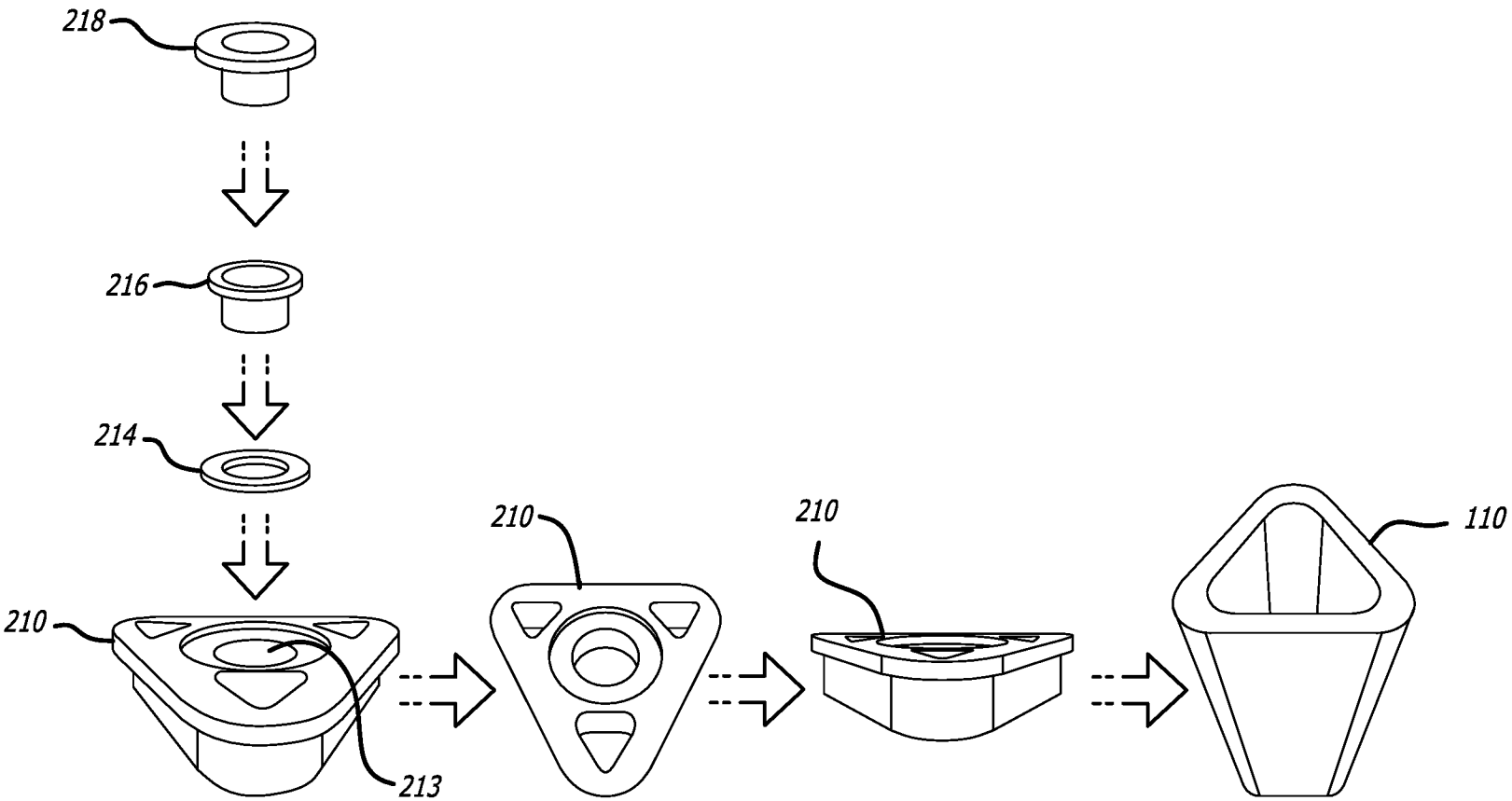
FIG. 3D is an assembly view illustrating how the bottom cap of FIG. 3A is assembled to the bottom of the casing body.

FIG. 3D illustrates another a partial exploded view of the bottom cap 200 and how the various parts of the bottom cap 200 may be assembled together with the body 110. As shown, the negative seat 218 may be installed into the attachment device 116 which, together, are fitted within the magnetic ring 214. The negative seat 218 assembly is then installed within aperture 213 before the bottom cap 200 is secured to the bottom of the casing body 110.

Figure 3E:
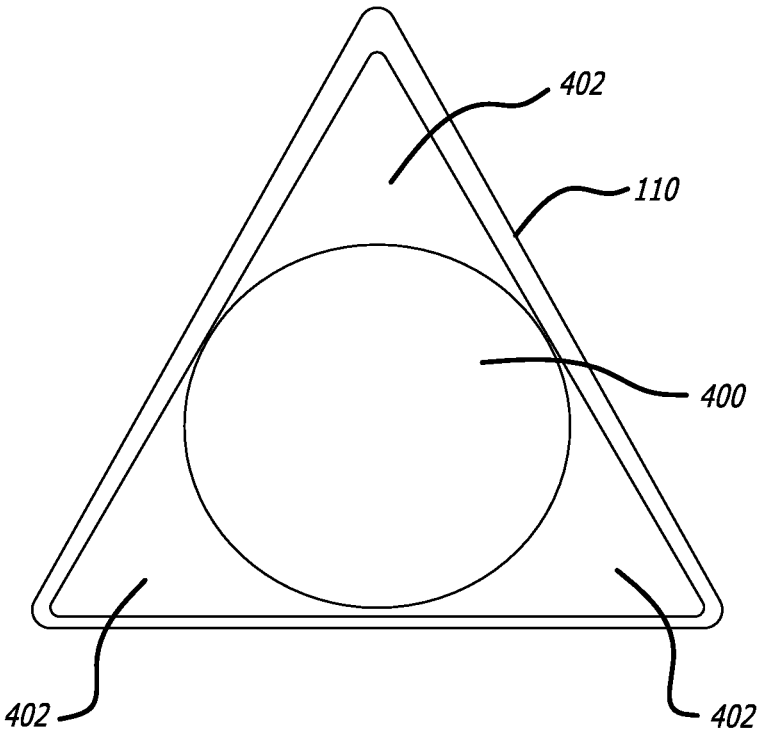
FIG. 3E is a cross-section view illustrating a battery installed within the casing body.

FIG. 3E is a cross-section of a battery 400 installed within the interior of the casing body 110. As shown, the configuration of the casing body 110 forms a plurality of cooling pockets 402 that form passages for atmospheric air to circulate around the battery 400 to cool the battery 400 by convection. The venting apertures 212 (FIG. 3C) facilitate the convection cooling by permitting heated air to escape from the interior of the casing body 110, while drawing in cooler atmospheric air.

FIGS. 4A-4E illustrate one example of an electronic vaporizer 300 of the present invention. The electronic vaporizer 300 generally includes a drip tip and an atomizer (not shown) similar to the drip tip 102 and the atomizer 120 shown in FIGS. 1 and 2A-2E, and described herein. The electronic vaporizer 300 may include a casing body 310 which may be constructed of titanium, or any other suitable materials. The casing body 310 is an elongate, hollow tube preferably with a triangular shape. In the example implementation shown, the casing body 310 has the shape of an equilateral triangle. As will be described in more detail herein, the casing body 310 may store three batteries.

Batteries with cylindrical shape, for example, lithium polymer or rechargeable lithium ion 18650 and 26650 batteries may be used with the electronic vaporizer 300.

Figure 4B:
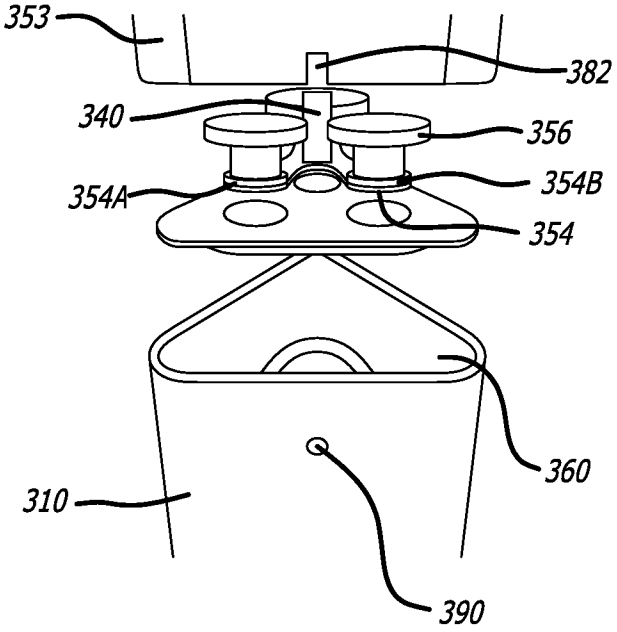
FIG. 4B is another perspective view of the atomizer of FIG. 4A.
Figure 4A:
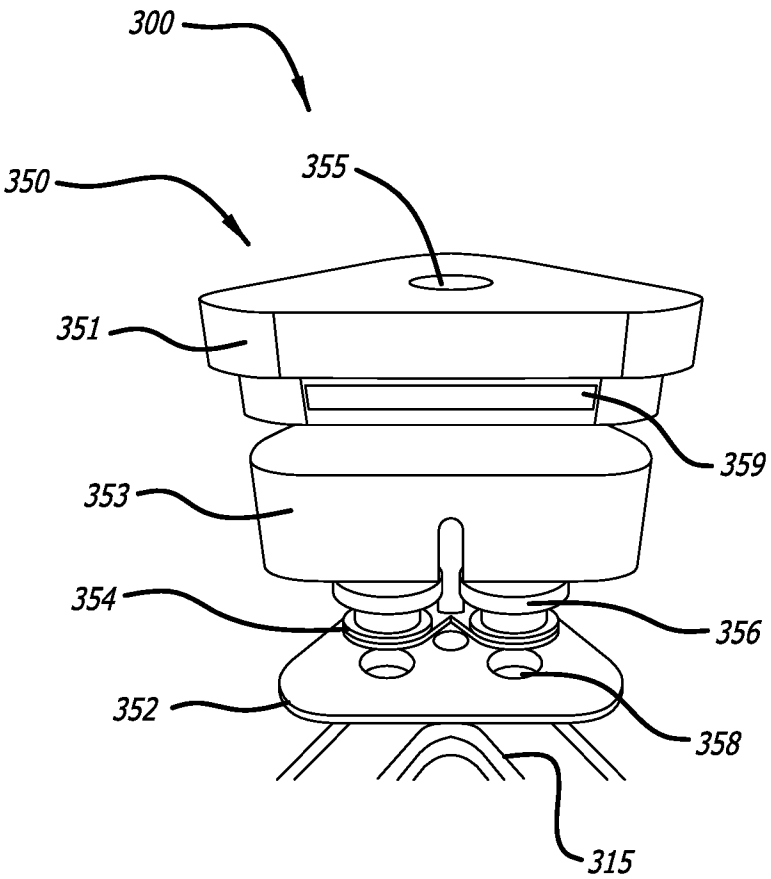
FIG. 4A is a perspective view illustrating another example of an atomizer of an electronic vaporizer in accordance with the teachings of the present invention.

FIG. 4A illustrates a top body cap 350. In the example implementation shown, the top body cap 350 has the shape of an equilateral triangle. The top body cap 350 may be used to cover the top opening of the body 310 by inserting the top body cap 350 into the hollow opening 360, and may provide negative conducting contact between the body 310 and the atomizer 120 (not shown). The top body cap 350 may include a cap housing 351 sized for housing a spacer 353, a center shaft 340, three posts 356, a bracket 354, and base 352. The housing 351 may include a threaded aperture 355 sized to receive the threaded section 134 of the positive pin 130 (not shown) of the atomizer 120 to attach (e.g., screw in) the atomizer 120 to the top body cap 350. The positive pin 130 may also be fit inside the center shaft 340 so that the positive pin 130 abuts the inside wall of the center shaft 340 to provide positive conducting contact to the atomizer 120.

The positive center shaft 340 may be coupled to the bracket 354. The bracket 354 may include three circular connectors (or seats) each is sized to fit into a corresponding circular aperture 358 positioned in the base 352. The three connectors (or seats) of the bracket 354 may extend through the apertures 358 and will extend into the inner hollow space 360 of the body 310. As will be described herein, the three bracket connectors (or seats) 354 will be coupled to the positive terminals of three corresponding batteries housed in the body 310. The three posts 356 provide support for the three bracket connectors 354.

The housing 351 may include a friction protrusion or grip 359 on each side to provide a tighter fit between the housing 351 and the inside wall of the body 310. The friction grip 359 may be made of, for example, Delrin®, plastic, rubber, or any other suitable material.

In some implementations, the spacer 353 and the posts 356 may be constructed of Delrin®, plastic, rubber, or any other suitable material.

When the top body cap 350 is fitted into body 310, the base 352 rests on the lip 315 positioned along the inside wall of the body 310.

Figure 4D:
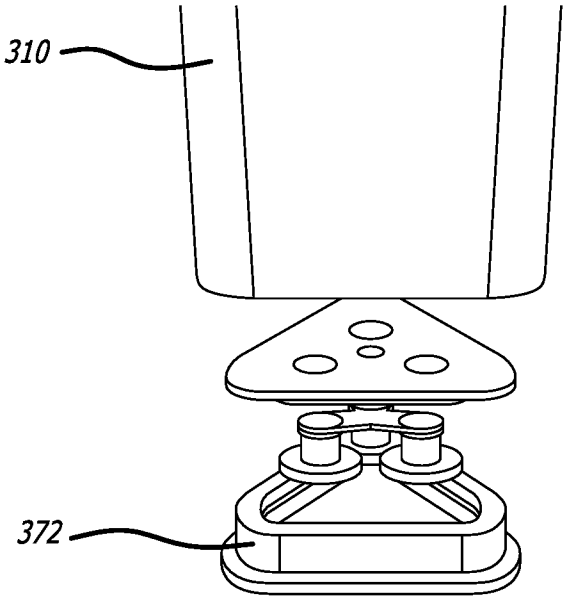
FIG. 4D is another perspective view of the bottom cap of FIG. 4C.
Figure 4C:
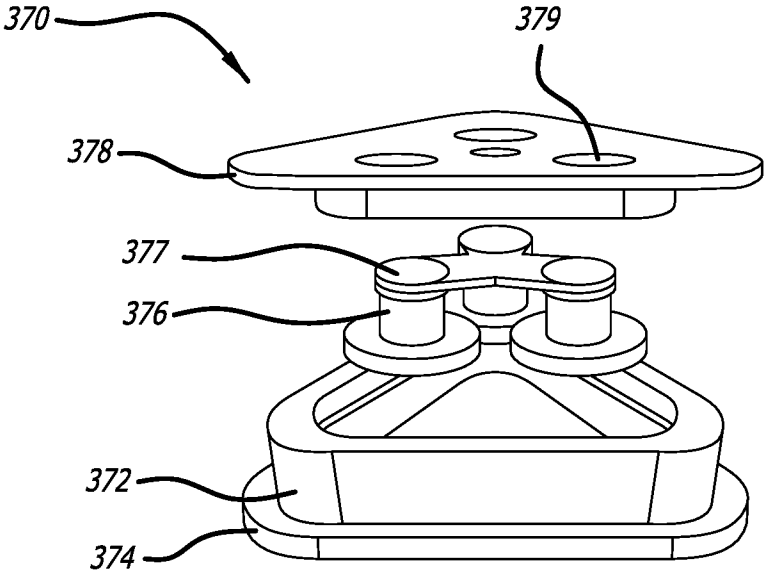
FIG. 4C is a perspective view illustrating another example of a bottom cap of an electronic vaporizer in accordance with the teachings of the present invention.

FIGS. 4C and 4D illustrate a body bottom cap (or base) 370. The bottom cap 370 may provide bottom cover for the body 310, conducting connectors to the negative terminals of the three batteries housed inside the body 310. The bottom cap 370 may include a housing 372 having a flange 374 positioned at the bottom edge thereof. The housing 372 may be sized for housing three posts 376, a bracket 377, and top 378. The bracket 377 may include three circular connectors (or seats) each is sized to fit into a corresponding circular aperture 379 positioned in the top 378. The three connectors (or seats) of the bracket 377 may extend through the apertures 379 and will extend into the inner hollow space 360 (FIG. 4B) of the body 310. As will be described herein, the three bracket connectors (or seats) 377 will be coupled to the negative terminals of the three corresponding batteries housed in the body 310. The three posts 376 provide support for the three bracket connectors 377. In some implementations, the posts 376 may be constructed of Delrin®.

Figure 4E:
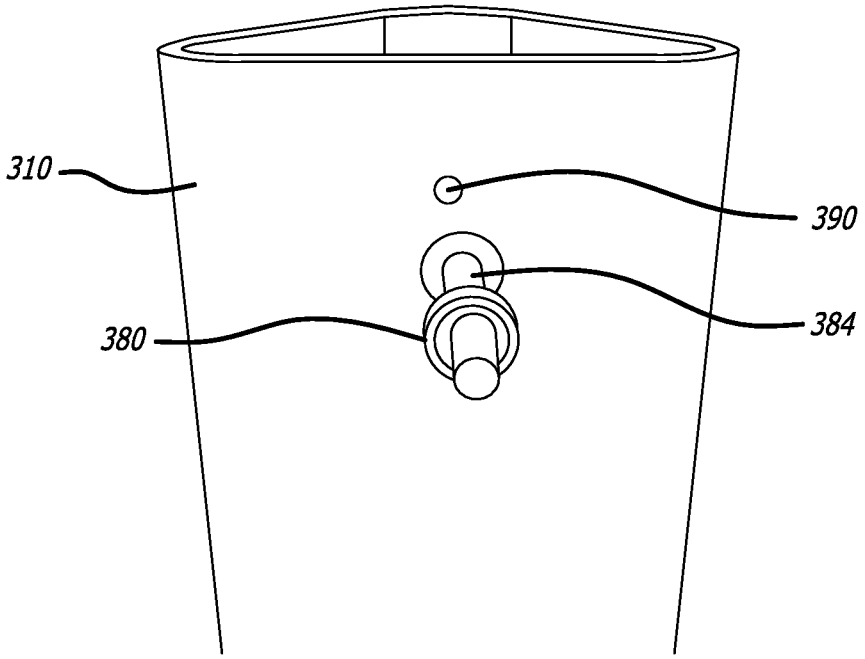
FIG. 4E is a side view illustrating one example of an electronic vaporizer having a side button in accordance with the teachings of the present invention.

FIG. 4E illustrates a push-pull button 380 for activating (turning ON) or deactivating (turning OFF) the electronic vaporizer 300. The button 380 may be positioned on a side of the body 310. The button 380 may include a rod 384 sized to fit through a corresponding aperture 390 positioned on the side, and in the top vicinity of the body 310. Looking at FIGS. 4B and 4E, the button 380 may be positioned such that when the rod 384 is pushed toward the inner space 360 of the body 310, the rod 380 may be positioned through the aperture 382 of the spacer 353, abutting in-between two posts 356, and may come into contact with the bracket 354 (e.g., with seats 345A and 345B) and with the positive shaft 340. This contact may complete the circuit between the batteries and the atomizer, and activating the electronic vaporizer 300.

Figure 5A:
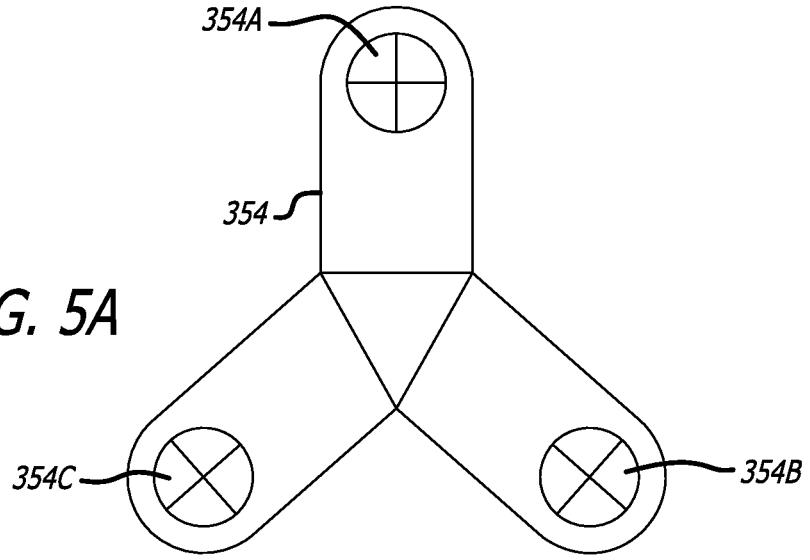
FIG. 5A is a top plan view illustrating one example of a bracket providing parallel circuitry for an electronic vaporizer in accordance with the teachings of the present invention.
Figure 5B:
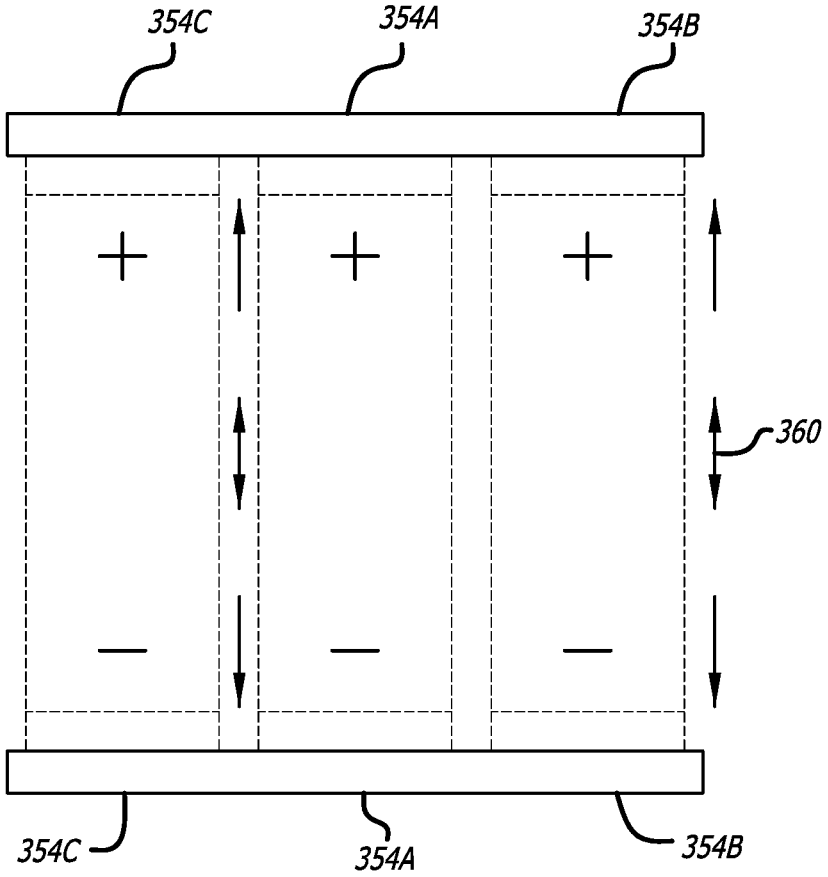
FIG. 5B is a schematic view illustrating the battery configuration for the parallel circuitry.
Figure 5C:
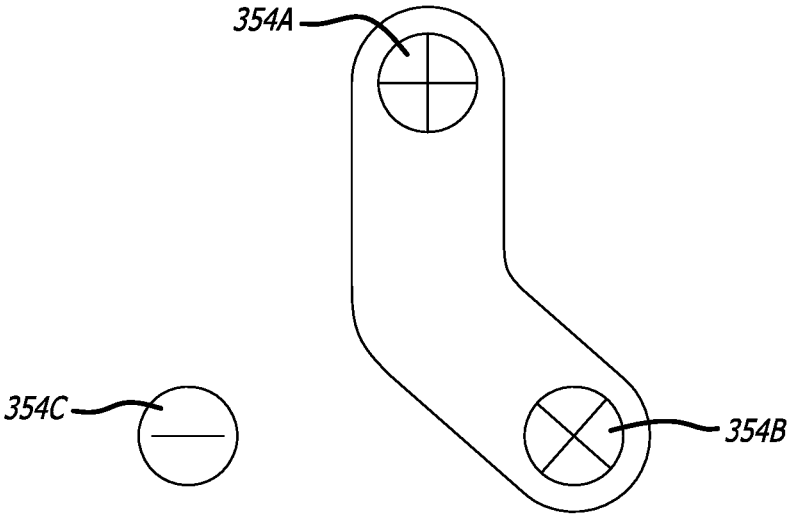
FIG. 5C is a top plan view illustrating one example of a bracket providing series circuitry for an electronic vaporizer in accordance with the teachings of the present invention.
Figure 5D:
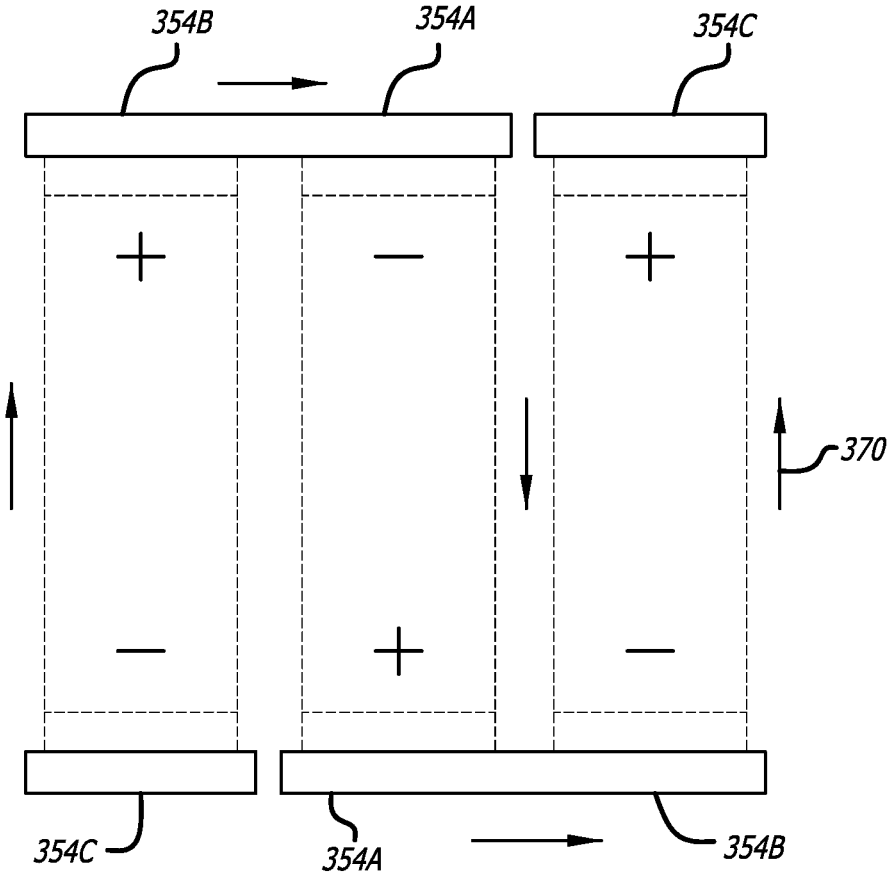
FIG. 5D is a schematic view illustrating the battery configuration for the series circuitry.

Turning to FIGS. 5A-5D, in some implementations, the electronic vaporizer 300 may be advantageously constructed using either parallel circuit (FIGS. 5A and 5B) or series circuit (FIGS. 5C and 5D). FIG. 5A illustrates one example top view of the bracket 354 (see also FIGS. 4A and 4B) having three connectors (or seats) 354A, 354B and 354C. As described herein, and shown in FIG. 5A, the bracket 354 and the connectors (or seats) 354A, 354B and 354C provide conducting contact for the positive terminals of the batteries housed in the electronic vaporizer 300. In this example implementation, the bracket 354 provides a parallel circuit for the electronic vaporizer 300. FIG. 5B illustrates how the batteries (shown in dashed lines) are disposed and oriented between the connectors 354A, 354B and 354C in the parallel circuit configuration. The electric current flow path is shown by arrows 360.

In the example implementation of FIGS. 5C and 5D, one branch, for example, connector (or seat) 354C, of the bracket 354 may be separated from the other two connectors (or seats) 354A and 354B. The corresponding battery of the isolated connector 354C may then be flipped such that the connector (or seat) 354C is coupled to the negative terminal of the battery. In this example implementation, the bracket 354 provides a series circuit for the electronic vaporizer 300. FIG. 5D illustrates how the batteries (shown in dashed lines) are disposed and oriented between the connectors 354A, 354B and 354C in the series circuit configuration. The electric current flow path is shown by arrows 370.

Figure 5E:
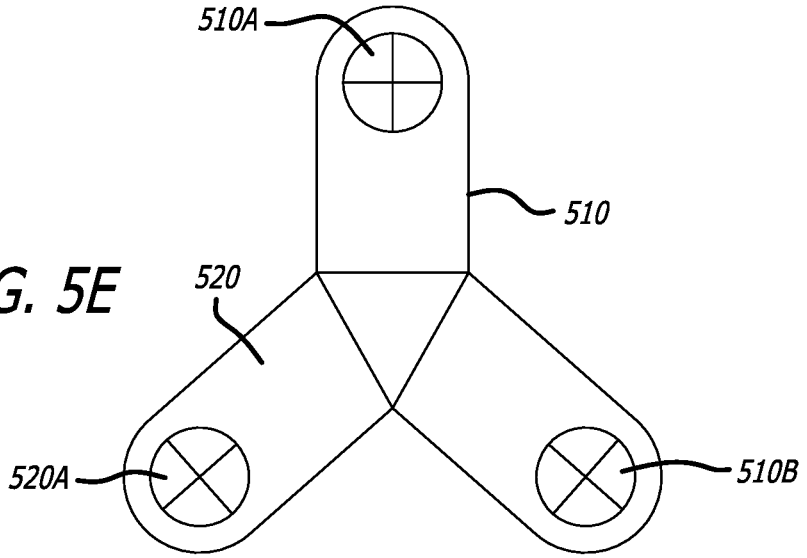
FIG. 5E is a top plan view illustrating one example of a bracket providing series circuitry for an electronic vaporizer in accordance with the teachings of the present invention.

FIG. 5E illustrates another implementation of a bracket assembly 500 for electronic connectors 510A, 510B, and 510C. According this example, electronic connectors 510A and 510B are electrically coupled via bracket element 510. In this example, bracket element 510 may be made of metal or any other suitable electrically-conductive material. Connector 520A may be physically coupled to, but electrically isolated from, connectors 510A and 510B via bracket element 520. Bracket element 520 may be made of rubber, Delrin®, or any other electrically non-conductive material.

While the present disclosure describes, in FIGS. 5A-5E, mechanical means for switching the electronic vaporizer between a parallel circuit and a series circuit, other implementations of the present invention may use an electronic controller or switch to automatically switch the vaporizer circuit between parallel and series configurations.

Figure 6:
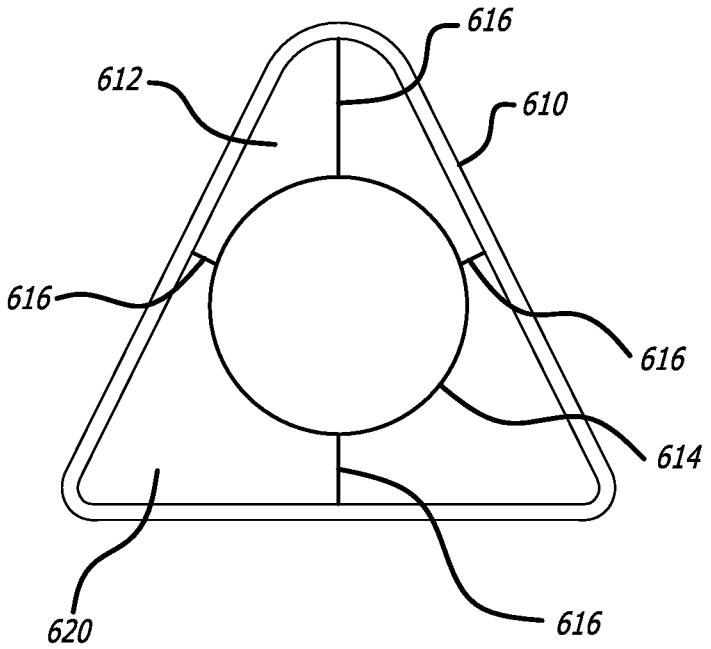
FIG. 6 is a cross-section view illustrating another example of the body of an electronic vaporizer in accordance with the teachings of the present invention.

FIG. 6 illustrates a top view of another example of the body 610 of an electronic vaporizer in accordance with the teachings of the present disclosure. As shown, the body may include triangular shape forming a generally triangular hollow interior 612. The hollow interior 612 is adapted to house a battery source 614. The body 610 may include a series of ribs 616 that extend into the hollow interior 612 to retain the battery source 614 in the center of the hollow interior 612. The ribs 616 further define a series of passages 620 for passing air heated by the battery source 614 out of the interior of the body 610.

Figure 7:
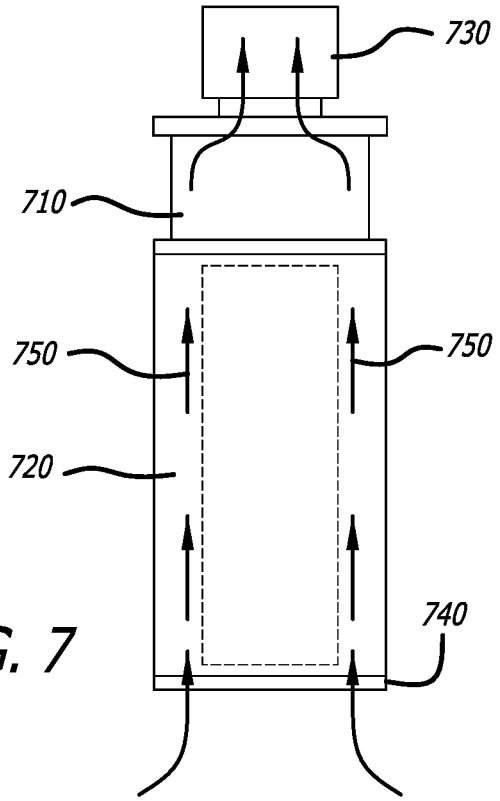
FIG. 7 is a side plan view of another example of an electronic vaporizer in accordance with the teachings of the present invention.

FIG. 7 illustrates an alternative implantation of an electronic vaporizer 700 according the teachings of the present invention. In this example, the atomizer 710 may not include vents. Instead, the base of the atomizer 710 and the top body cap of the casing body 720 may include vents that enable air to communicate between the atomizer chamber and the hollowed interior of the casing body. In this way, when the user inhales vapor through the drip tip 730, air may be drawn from the vents in the bottom cap 740 through the hollowed interior of the casing body 720 and atomizer 710, as shown by arrows 750. In this example, the air inhaled by the user promotes convection cooling of the battery. In such implementations, the should be properly encapsulated to prevent fumes, acid, or other battery debris from being inhaled by the user. In addition, screen mesh may be incorporated into the vents in the atomizer base and/or top body cap, or a screen mesh may be incorporated into the base of the drip tip 730.

Electronic vaporizers of the present invention may include other components not shown or described herein for simplicity. It is noted that electronic vaporizers of the present invention may include a controller for controlling the amount of voltage and current received by the atomizer from the battery or batteries, such that the atomizer receives an appropriate amount of electrical voltage and current.

Figure 8:
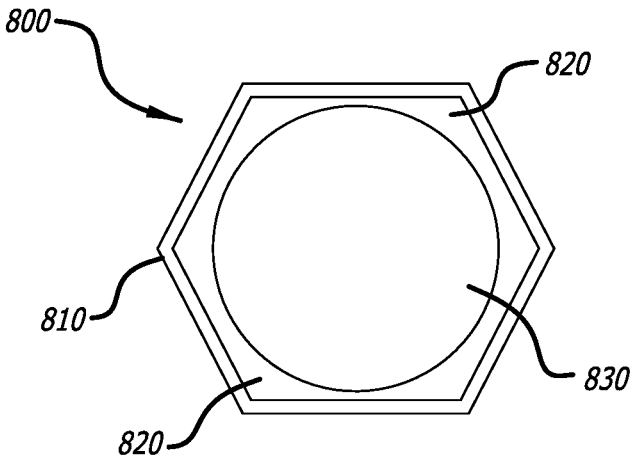
FIG. 8 is a cross-section view illustrating another example of a casing body of an electronic vaporizer in accordance with the teachings of the present invention.

While the implementations of the electronic vaporizers described herein comprise a triangular shape, electronic vaporizer of the present invention may incorporate any polygon shape. For example, as shown in FIG. 8, the electronic vaporizer 800 may include a casing body 810 having a hexagon shape, forming cooling pockets 820 about the battery 830, in its interior. Implementations of the electronic vaporizers described herein further describe the atomizer and casing body as having corresponding shape. But one of ordinary skill will appreciate that the shape of the atomizer and the casing body may not correspond.

In general, terms such as "coupled to," and "configured for coupling to," and "secured to," and "configured for securing to" and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic or fluidic relationship between two or more components or elements. As such, the fact that one component is said to be in communication with a second component is not intended to exclude the possibility that additional components may be present between, and/or operatively associated or engaged with, the first and second components.

Although the previous description illustrates particular examples of various implementations, the present disclosure is not limited to the foregoing illustrative examples. A person skilled in the art is aware that the disclosure as defined by the appended claims and their equivalents can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. An electronic vaporizer comprising:

a triangular tubular body for housing a cylindrical battery;

a triangular-shaped atomizer coupled to a first end of the tubular body, the atomizer including a drip tip, a base plate, and an aperture positioned at each side of the atomizer, each aperture permitting air to flow into the atomizer; and a triangular-shaped base coupled to an opposing end of the tubular body;

and wherein the triangular tubular body comprises one or more cooling pockets for facilitating convection cooling of the battery.

2. The electronic vaporizer of claim 1 further comprising an air flow control ring, the air flow control ring being adjustable about the atomizer between a first position obstructing air flow into each aperture and a second position allowing air flow into each aperture.

3. The electronic vaporizer of claim 1 further comprising an electrically conductive pin, the pin being in electrical communication between the atomizer and the battery.

4. The electronic vaporizer of claim 3 further comprising one or more heating coils housed within the atomizer, the heating coils being coupled between the base plate and the pin wherein the base plate functions as an electrical ground and the pin serves as a positive terminal.

5. An electronic vaporizer comprising:

a triangular tubular body for housing three battery sources, the tubular body having a top and bottom;

a triangular-shaped atomizer positioned on top of the triangular tubular body, the atomizer including a drip tip, a base plate, and an aperture positioned at each side of the atomizer, each aperture permitting air to flow into the atomizer; and a triangular-shaped base coupled to the bottom of the triangular tubular body; and wherein the triangular tubular body comprises one or more cooling pockets for facilitating convection cooling of the battery; and three electrical connectors coupled to the triangular-shaped base, wherein each battery source is connected to an electrical connector, the battery sources being electrically connected in either parallel or series.

6. The electronic vaporizer of claim 5 further comprising an air flow control ring, the air flow control ring being adjustable about the atomizer between a first position obstructing air flow into each aperture and a second position allowing air flow into each vent aperture.

7. The electronic vaporizer of claim 5 wherein the battery sources may be switched from a parallel to a series connection by electrically isolating one of the electrical connectors and changing the electrical orientation of one of the battery sources relative to the other two battery sources.

* * * * *